US007267516B1

(12) United States Patent
Sorensen

(10) Patent No.: US 7,267,516 B1
(45) **Date of Patent: *Sep. 11, 2007**

(54) PEDESTAL MOUNTED LIGHT POLE ERECTOR AND REMOVER

(76) Inventor: Jay A. Sorensen, 761 Thunderbolt Ave., Lake Havasu, AZ (US) 86406

( * ) Notice: Subject to any disclaimer, the term of this patent is extended or adjusted under 35 U.S.C. 154(b) by 295 days.

This patent is subject to a terminal disclaimer.

(21) Appl. No.: 11/068,239

(22) Filed: Mar. 1, 2005

(51) Int. Cl.
*B66F 11/00* (2006.01)

(52) U.S. Cl. ..... 414/23; 414/911

(58) Field of Classification Search ..... 414/23, 414/911

See application file for complete search history.

(56) References Cited

U.S. PATENT DOCUMENTS

| | | | | |
|---|---|---|---|---|
| 3,190,465 | A * | 6/1965 | Newman | 414/23 |
| 4,691,956 | A * | 9/1987 | Hodge | 296/51 |
| 5,403,024 | A * | 4/1995 | Frketic | 280/43.12 |
| 5,794,387 | A * | 8/1998 | Crookham | 52/122.1 |
| 5,899,651 | A * | 5/1999 | Jenvey | 414/23 |
| 6,368,048 | B2 * | 4/2002 | Womble et al. | 414/590 |
| 6,540,241 | B2 * | 4/2003 | Lee | 280/43.12 |
| 6,709,215 | B1 * | 3/2004 | Sorensen | 414/23 |
| 2001/0045548 | A1 * | 11/2001 | Landy | 254/217 |
| 2002/0192053 | A1 * | 12/2002 | Ewington | 414/23 |

* cited by examiner

*Primary Examiner*—Joshua Rudawitz
(74) *Attorney, Agent, or Firm*—Albert O. Cota

(57) ABSTRACT

A light pole erector and remover (10) for pedestal mounted light poles (74) that is comprised of three major elements: a transportation dolly (20), a pedestal attaching and lifting mechanism (22), and a pole tilting mechanism (24). The dolly (20) has fixed and steerable wheels attached to a tongue (34). The mechanism (22) is hinged to the dolly (20) and has a pair of base support arms (52) that embrace a concrete pedestal (56). Each arm (52) has a ratchet buckle tie-down (58) used for encircling the pedestal (56) and securing the mechanism (24) to the pedestal (56). The mechanism (24) is pivotally affixed to the mechanism (22) and includes a pair of ratchet buckle tie-downs (58) that encircle and secure the pole (74) to the invention (10). The pole (74) is horizontally positioned on the tilting mechanism (24), tied down and rotated to a vertical position over the concrete pedestal (56) and then lowered for attachment to the pedestal (56). The invention (10) also permits the pole (74) to be removed for repair or replacement.

17 Claims, 8 Drawing Sheets

PEDESTAL MOUNTED LIGHT POLE ERECTOR AND REMOVER

TECHNICAL FIELD

The invention generally pertains to pole erecting and removal devices, and more specifically to an erecting apparatus that raises, sets and removes poles or standards that are mounted on a pedestal.

BACKGROUND ART

Previously, many types of utility poles have been used with integral pivoting members that attach to a pedestal to provide an effective means to easily erect the pole to the upright position. There has been devices developed, which are complex and expensive, that grip a pole and position it upright or remove it from a pedestal using hydraulic pressure.

Prior art found did not disclose any patents that possess the novelty of the instant invention, however the following U.S. patents are considered related:

| U.S. Pat. No. | Inventor | Issue Date |
|---|---|---|
| 4,878,160 | Reneau et al. | Oct. 31, 1989 |
| 4,903,442 | Trommen | Feb. 27, 1990 |
| 5,398,478 | Gordin et al. | Mar. 21, 1995 |
| 5,794,387 | Crookham | Aug. 18, 1998 |
| 6,386,048 | Womble et al. | Apr. 9, 2002 |
| 6,709,215 | Sorensen | Mar. 23, 2004 |

Reneau et al. in U.S. Pat. No. 4,878,160 teaches a service pole assembly that utilizes a pair of hinged support members to provide either a stable support of the pole in an erect position or to permit the pole to swing downward, thus providing convenient access for service or maintenance.

U.S. Pat. No. 4,903,442 issued to Trommen is for a mast that is used for measuring or illumination, particularly for flight navigation lights or for wind measuring devices which utilize a glass fiber or carbon fiber reinforced plastic mast.

Gordin et al. in U.S. Pat. No. 5,398,478 discloses a method for rigidly elevating a structure, such as a pole, which has a base member that is securable in the ground and a portion that extends above the ground. A pole section having a bore inside, a lower end and an upper end. The pole section can be stacked upon the base upward, by slip fitting the pole section into the base end and securing it into place.

Crookham in U.S. Pat. No. 5,794,387 teaches an apparatus for manipulating a pole relative to a base that is rigidly fixed in the ground. The base is gripped and provides a rigid reference point. The pole is cradled and an actuator provides a force that allows the pole to be moved relative to the reference point. The device can detach the pole from the base as well as installing it on the base. A pivot mechanism allows the pole to be pivoted with respect to the base to allow the pole to be lowered for inspection and maintenance or to erect the pole vertically and then seat it upon the base.

U.S. Pat. No. 6,386,048 issued to Womble et al. is for a cart for transporting elongated objects such a compressed gas cylinders, and for moving the objects from a first surface to a second surface. The cart includes an object retainer which is pivotally mounted to a frame and may be removably engaged with the object at its center of gravity. The invention also includes a height adjustable retainer.

U.S. Pat. No. 6,709,215 is a previous patent issued to Sorensen who is also the inventor of the instant improved invention. The U.S. Pat. No. 6,709,215 teaches a light-pole erecting and lowering apparatus that allows a single person to install, remove and service a light pole attached to an above-ground concrete pedestal. The invention consists of an integrated unit incorporating three major elements: a transporting dolly, a pole platform and pedestal attachment frame and a pole securing assembly. The dolly permits transportation in a horizontal position or an operable vertical position. The pole platform and pedestal attachment frame securely connects the invention to the pedestal, and the pole securing assembly permits the pole to be rotated to either a horizontal or a vertical position.

DISCLOSURE OF THE INVENTION

Installing and removing light poles typically, requires large and expensive equipment to lift and erect a pole on a concrete pedestal as the pole must be tilted upward and then lifted onto the pedestal. Since there are multitudes of parking lots and the like throughout the world, and lighting is required, the most common approach is to utilize light poles with lights attached to the top and with concrete pedestals on the bottom to protect the pole from an impact of surrounding vehicles. The poles are typically 30 feet or more in height, thus making them difficult to handle and requiring specialized equipment. Therefore, the primary object of the invention is to provide an apparatus that permits a single person to install, remove and service a light pole of the type attached to an above-ground concrete pedestal.

An important object of the invention is the ability to easily transport the apparatus to a construction site, or for servicing the pole in a completed parking lot using a portable dolly with pneumatic tires.

Another object of the invention is that the apparatus may be stored in a collapsed, position, thereby permitting easy storage and transportation in a motor vehicle.

Still another object of the invention is in the elimination of expensive cranes or cherry pickers, while accomplishing the same task with a small portable apparatus.

Yet another object of the invention is that any style of pole may be serviced relative to the diameter, shape and style, such as round, square, polygonal, or irregular shape.

A further object of the invention is the simplicity of design, as only the essential components are utilized, thus maximizing the utility while minimizing the structure.

A further object of the invention is the ease of operation, as the apparatus is easy to pull or push into place with a steerable set of wheels, and the tee handle tongue is stored in an upright, out of the way position.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
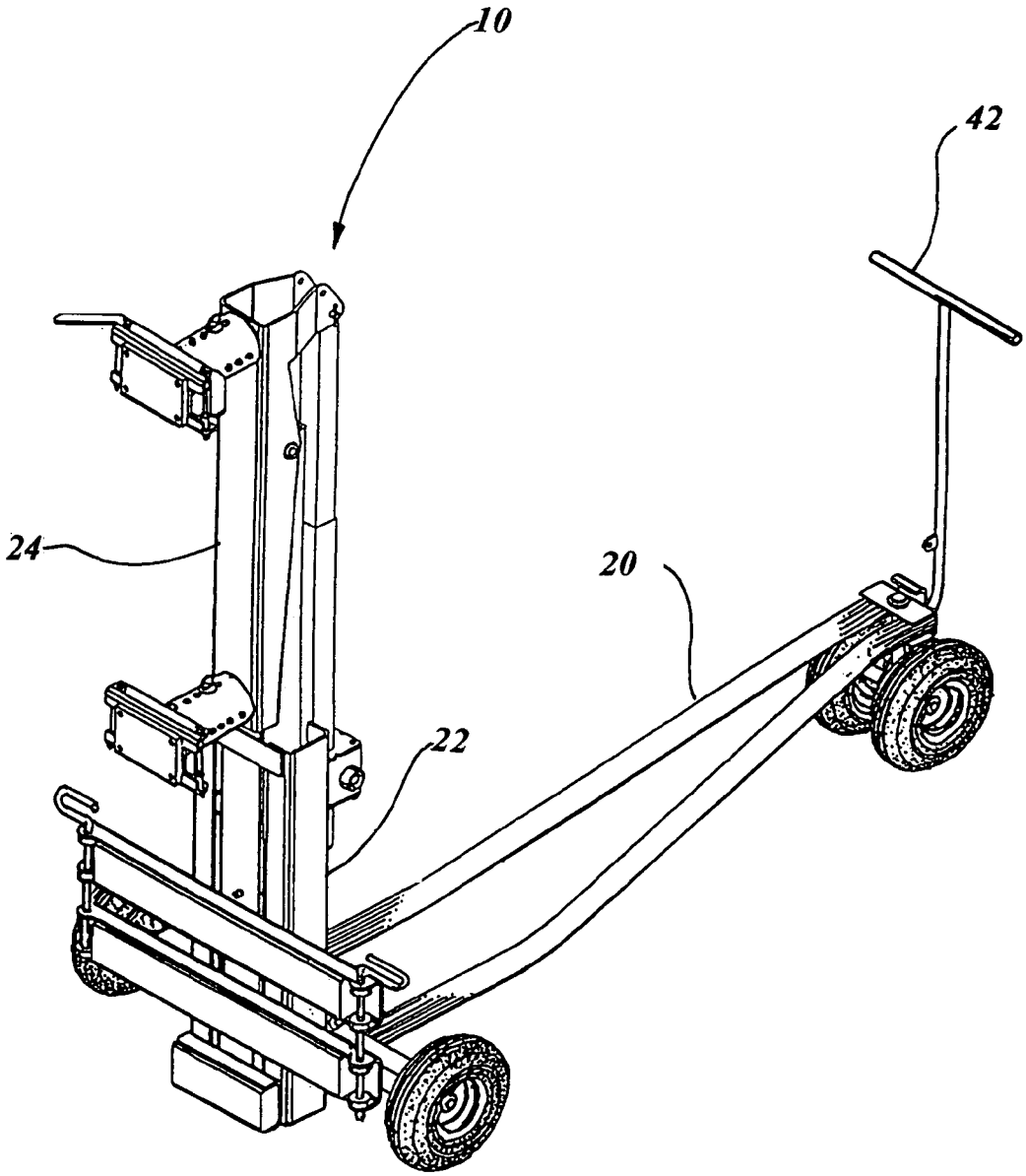
FIG. 1 is a partial isometric view of the pedestal mounted, light pole erector and remover in a preferred embodiment.
Figure 2:
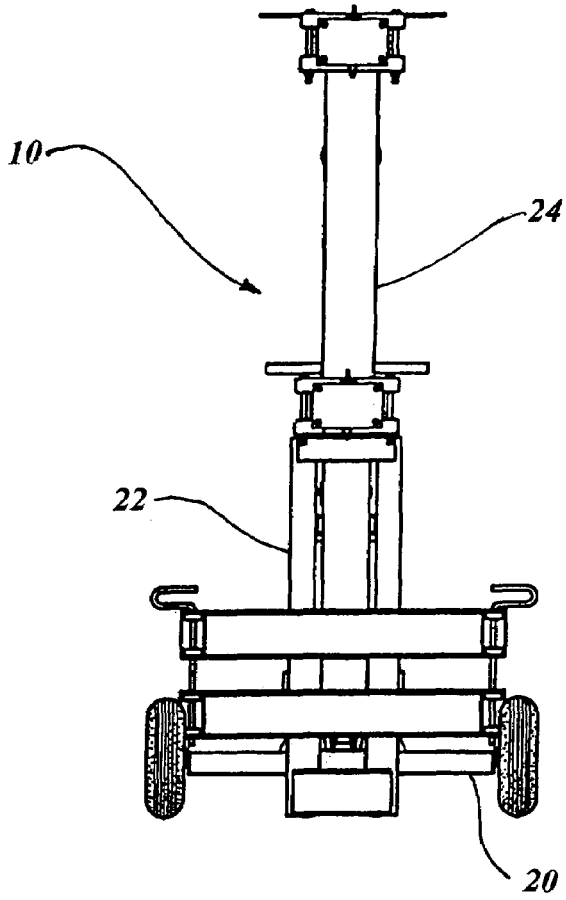
FIG. 2 is a front view of the preferred embodiment.
Figure 3:
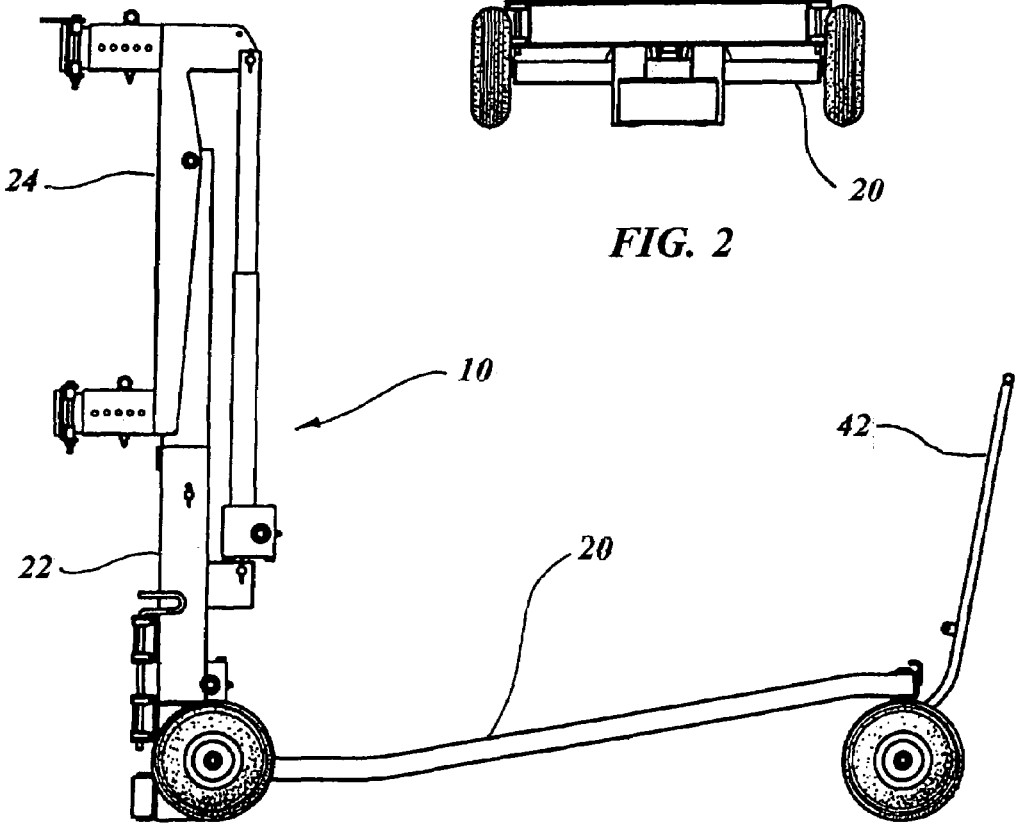
FIG. 3 is a right side view of the preferred embodiment.

The best mode for carrying out the invention is presented in terms of a preferred embodiment for a light pole erector and remover for a pedestal mounted light pole. The preferred embodiment of the light pole erector and remover 10, as shown in FIGS. 1 through 14, is comprised of three major elements: a transportation dolly 20, a pedestal attaching and lifting mechanism 22, and a pole tilting mechanism 24.

The transportation dolly 20, as shown in FIGS. 1-4 and 5 by itself, includes a frame 26 with a pair of fixed wheels 28 on a first end 30, and steerable wheels 32 that are attached to a tongue 34 on a second end 36. The frame 26 is preferably a weldment consisting of a pair of tubular metallic, longitudinal struts 38 that are attached on the first end 30 to an axle 40. The struts 38 are attached on the second end 36 with the tongue 34, which is further defined as a pivoting tee handle 42, thus permitting the dolly 20 to be manually steered when pulled or pushed in a forward or aft direction.

Figure 4:
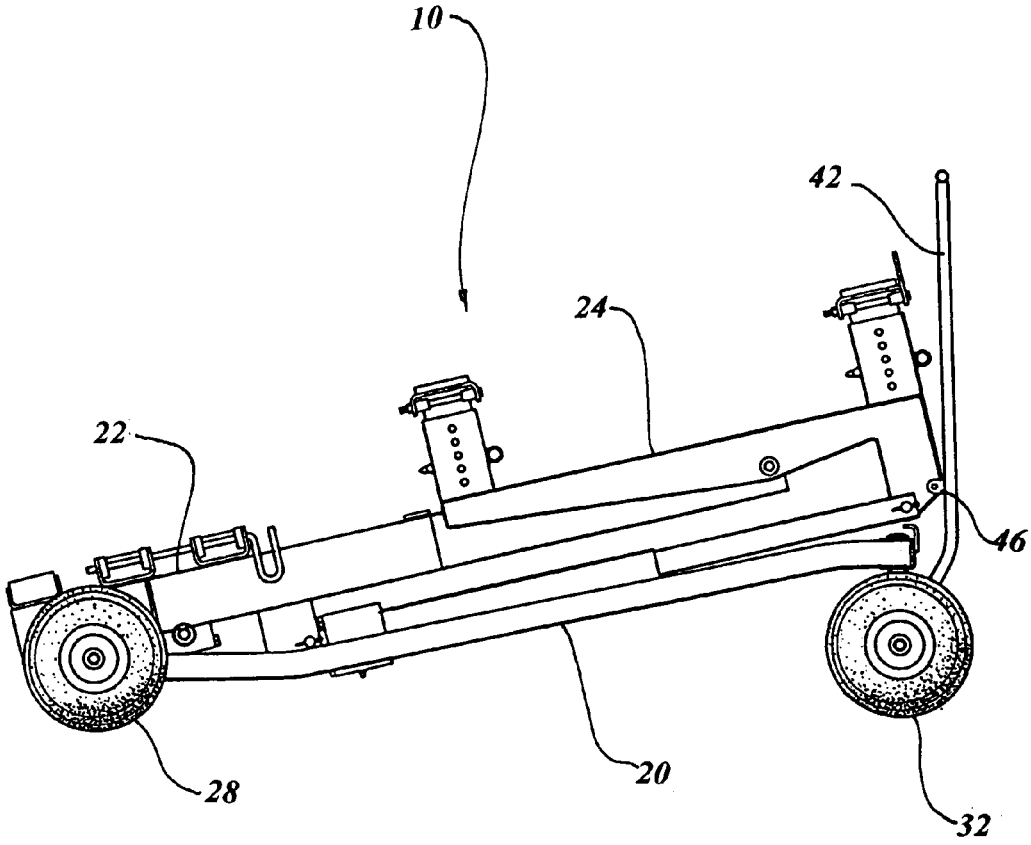
FIG. 4 is a left side view of the preferred embodiment with the pedestal attaching and lifting mechanism, and pole tilting mechanism, folded onto the transportation dolly.

The dolly frame tongue tee handle 42 includes means for locking the handle in an upright position for storage. The means preferably consists of a clip 46 that interfaces with the pole tilting mechanism 24 when it is collapsed onto the dolly 20, as shown in FIG. 4. While a clip 26 is described and illustrated, any type of attachment may be used with equal ease and dispatch.

Figure 5:
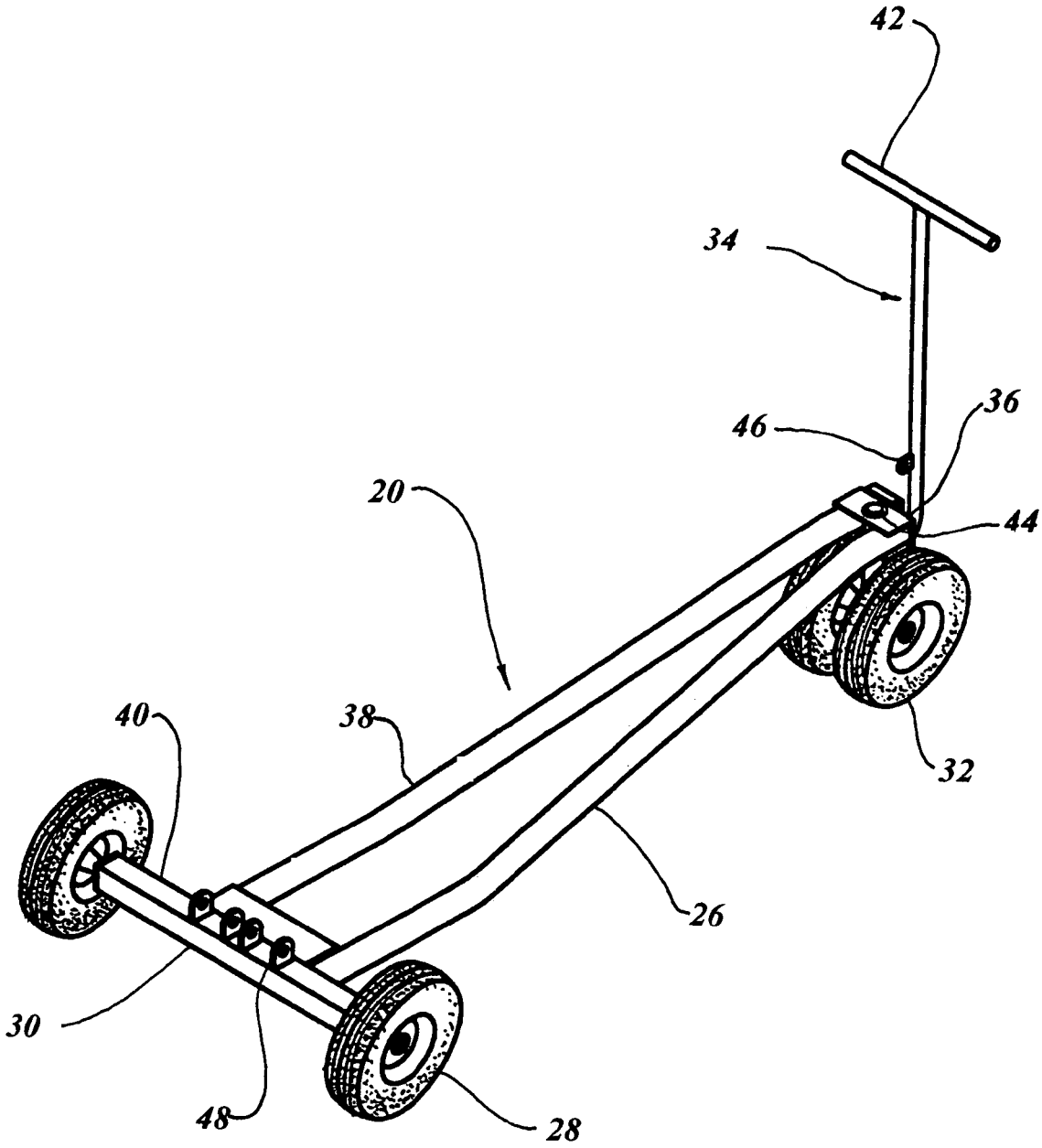
FIG. 5 is a partial isometric left side view of transportation dolly in the preferred embodiment shown removed from the invention for clarity.
Figure 11:
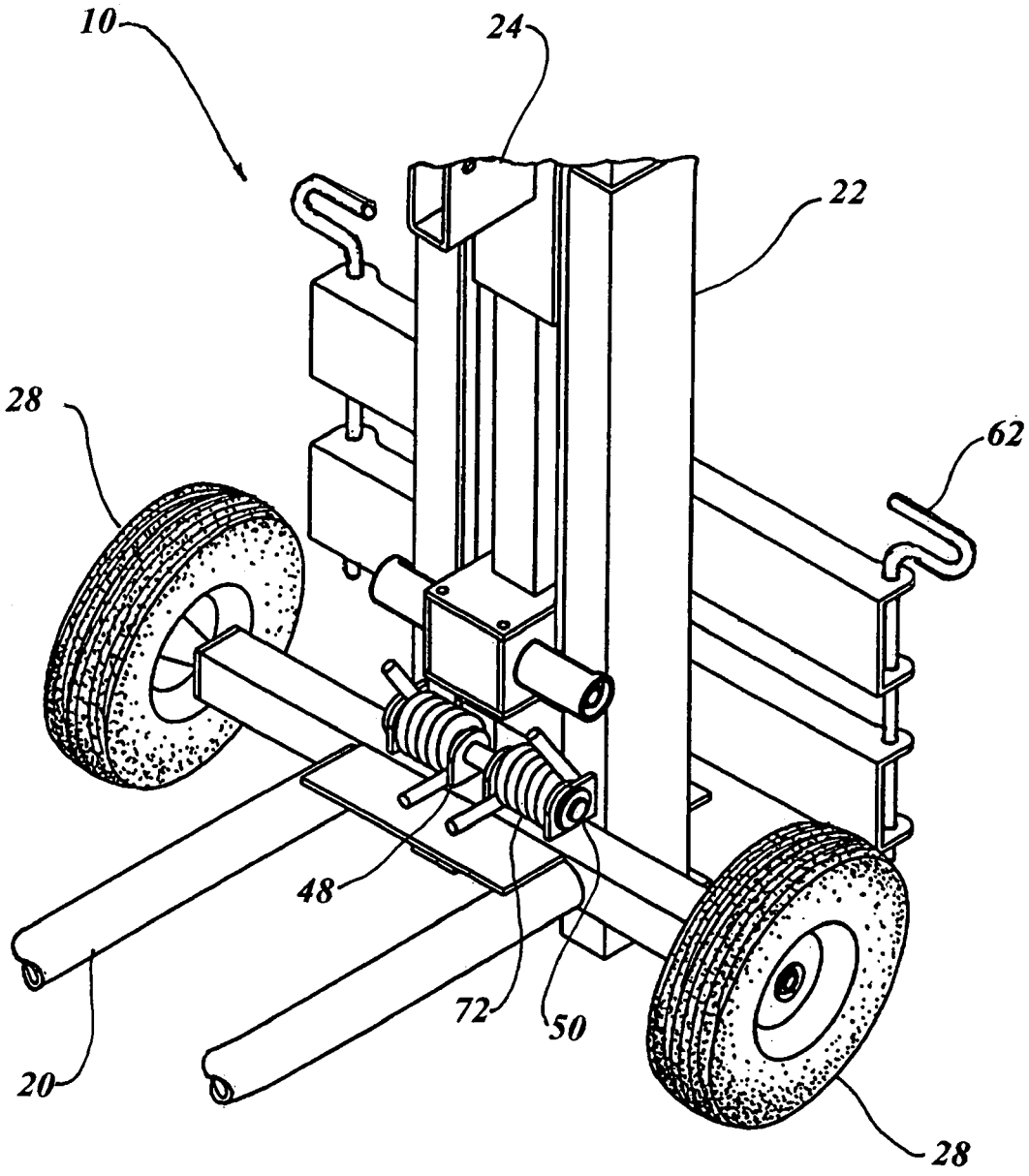
FIG. 11 is a partial isometric view of the preferred embodiment illustrating the invention in its upright position viewed from the rear showing the counterbalance torsion springs.

The steerable wheels 32 are attached to a fifth wheel pindle 44, as shown best in FIG. 5, with both the steerable and fixed wheels 32 and 28 respectively, consisting of wheel rims with pneumatic tires. While any size and rating tire may be used, the wheels preferably have a 10 inch (25.4 centimeter) diameter and a 4.10/3.5 rating, which has been tested and found to be optimum for ease of movement and stability. A plurality of hinge leaf brackets 48 are welded to the axle 40 for pivotal connection of the attaching and lifting mechanism 22, thereby completing the structure of the dolly 20. The pedestal attaching and lifting mechanism 22 also contains mating hinge leaf brackets 48, as shown in FIG. 11. The hinge connection between the dolly 20 and attaching and lifting mechanism 22 is made using a hinge pin 50, with retaining rings on each end that penetrate through the adjacent hinge leaf brackets 48.

Figure 6:
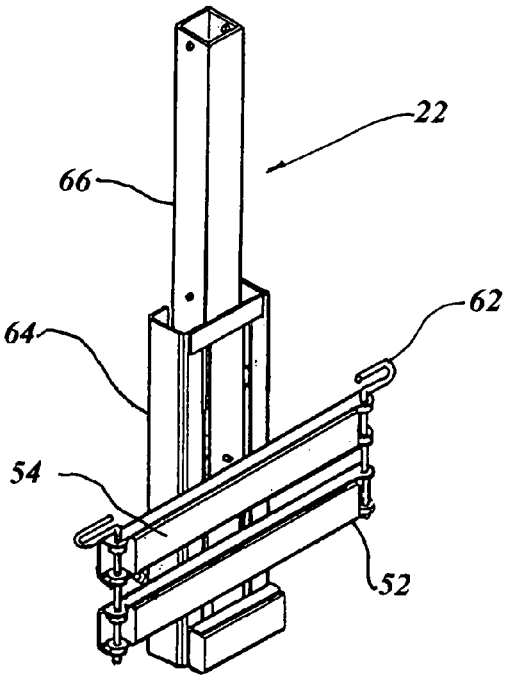
FIG. 6 is partial isometric view of the pedestal attaching and lifting mechanism in the preferred embodiment shown removed from the invention for clarity.
Figure 7:
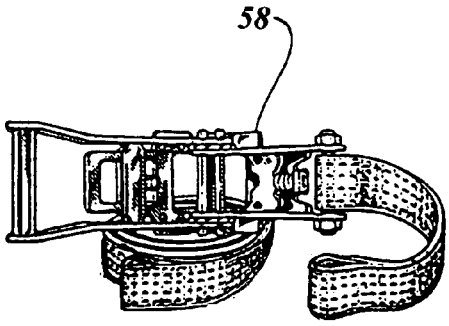
FIG. 7 is a partial isometric view of one of the ratchet tie-downs in the preferred embodiment shown removed from the invention for clarity.
Figure 8:
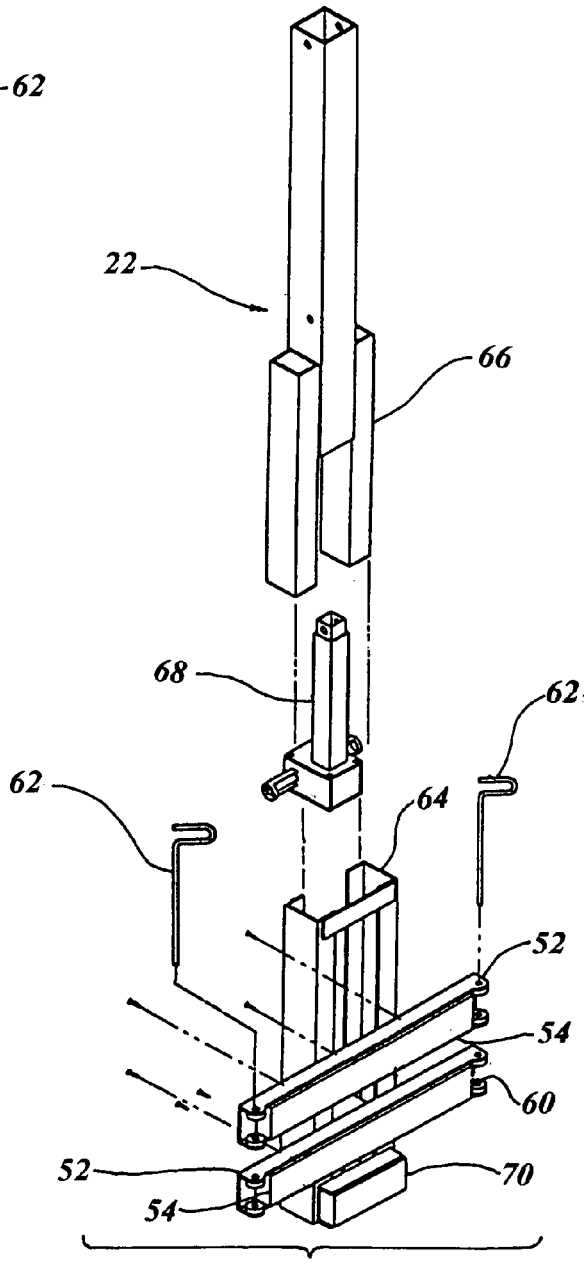
FIG. 8 is partial isometric exploded view of the pedestal attaching and lifting mechanism in the preferred embodiment shown removed from the invention for clarity.
Figure 9:
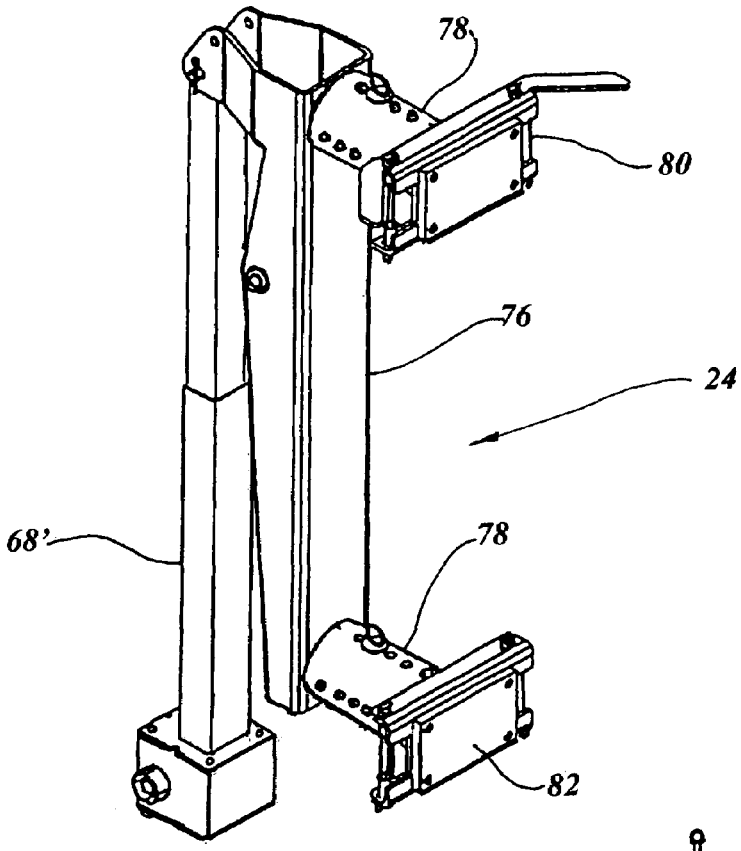
FIG. 9 is partial isometric view of the pole tilting mechanism in the preferred embodiment shown removed from the invention for clarity.
Figure 10:
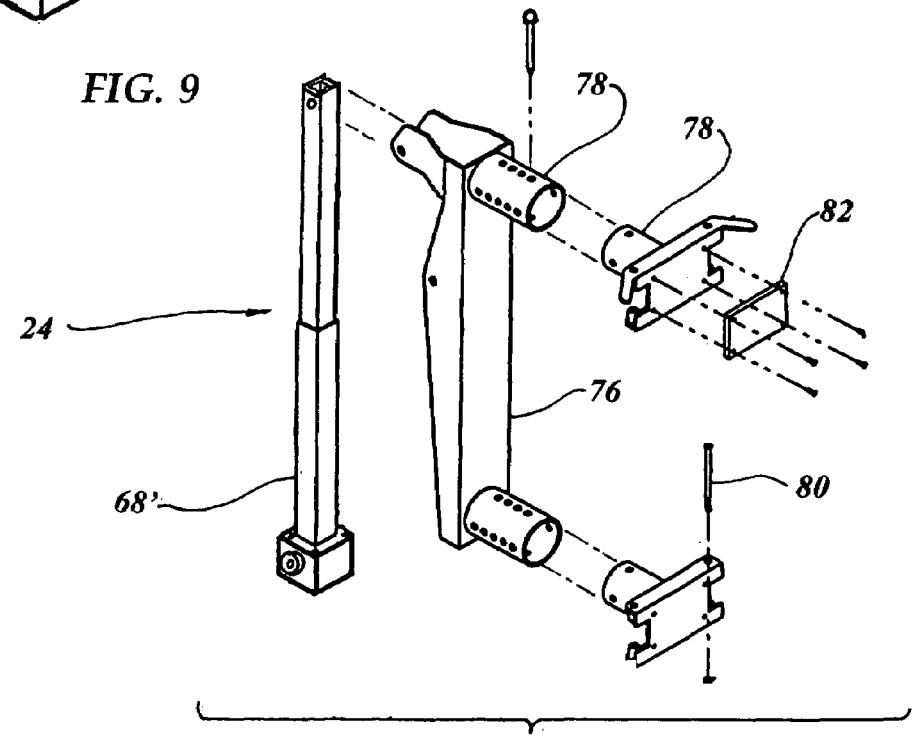
FIG. 10 is partial isometric exploded view of the pole tilting mechanism in the preferred embodiment shown removed from the invention for clarity.

The pedestal attaching and lifting mechanism 22, is illustrated in FIGS. 6 and 8, completely removed from the other components of the invention and consists of preferably two support arms 52, that are configured in a channel shape with a wood bumper 54 attached to intimately embrace a concrete pedestal 56. Each arm 52 utilizes a ratchet buckle tie-down 58, as shown in FIG. 7, that is used to encircle the pedestal 56, thereby removably securing the mechanism to the pedestal 56. Each base support arm 52 has four bores 60 therethrough, and removable ratchet attaching pins 62 are disposed through two of the bores 60, with one on each end of the arms 52, as shown in FIGS. 1-4, 6,8 and 11-14 in concert with both arms 52.

The base support arms 52 of the attaching and lifting mechanism 22 are permanently connected to a pair of opposed upright channel guides 64, as shown best in FIG. 8. A sliding glide rail assembly 66 is disposed within the channel guides 64, and a screw type lifting actuator 68 is located within the sliding glide rail assembly 66. A bottom positioner 70 is connected to a front surface of the channel guides 64, thereby completing the attaching and lifting mechanism 22.

At least one, but preferably two, counterbalance torsion springs 72 are positioned between the attaching and lifting mechanism 22 and the transportation dolly 20, as shown in FIG. 11, for ease of manual lifting. The springs 72 are held in place with the hinge pin 50 and located between the hinge leaf brackets 48.

The pole tilting mechanism 24 is pivotally affixed to the pedestal attaching and lifting mechanism's sliding guide rail assembly 66, as shown in FIGS. 1-4 and 12-14. The pole tilting mechanism 24 includes a pair of ratchet buckle tie-downs 58 of the same type as previously described. The tie-downs 58 encircle a pole 74, thus securing the pole 74 to the tilting mechanism 24 such that the pole 74 may be manually positioned in a horizontal manner on the tilting mechanism 24, tied down and rotated to a vertical position over the concrete pedestal 56 and then lowered for attachment to the pedestal 56. This procedure may be reversed, thereby permitting the pole to be removed for repair or replacement.

Figure 14:
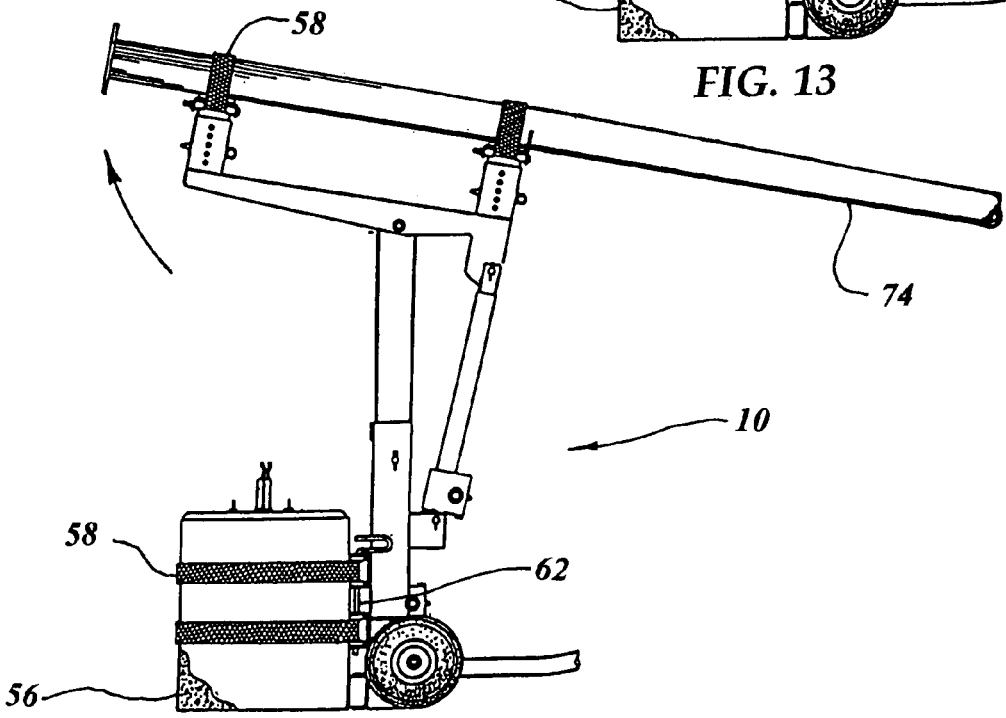
FIG. 14 is a left side view of the invention attached to a concrete pedestal and a pole, with the pole rotated horizontally for repair of the lamp on the post or removal of the pole.

The pole tilting mechanism 24 consists of a channel-shaped pivotal member 76 that is formed from a flat sheet of material, and has a pair of adjustable pole attaching arms 78, that are each attached on opposed ends onto a web portion of the channel-shaped member 76. The arms 78 are configured to receive the ratchet buckle tie-downs 58 utilizing a number of removable ratchet attaching bolts 80 that penetrate through the adjustable pole attaching arms 78. The adjustable feature of the attaching arms 78 is accomplished by using a pair of mated cylinders that telescope together and are positioned at the appropriate length with conventional hardware through a plurality of aligned holes, a procedure that is well known in the art. A rubber pad 82 is provided on each of the attaching arms 78 to protect the pole 74 when being lifted. A screw type lifting actuator 68' is attached to one end of the pivotal member 76 for rotating the member 76 from a horizontal to a vertical position, as shown in FIG. 14.

The pole tilting mechanism 24 pivots from 0 to essentially 120 degrees relative to the transportation dolly 20, and is configured to be manually liftable by one person.

The light pole erector and remover 10 is sized to fit a concrete pedestal that protrudes above the ground at a height from 18 inches to 36 inches (45.7 to 91 centimeters). The ratchet buckle tie-downs 58 are rated to at least 2,500 pounds (1135 kg) and have 2 inch (5.1 cm) wide straps for accommodating square, polygonal, round and irregular shaped poles that are utilized for both the attachment and lifting mechanism 22 and pole tilting mechanism 24.

During operation, the light pole erector and remover 10 has two functions: to install and/or remove a pole 74 from a concrete pedestal 56. For installation the invention is pulled or pushed to a work site on the dolly 20, which is usually stored and transported in a folded-down position, as shown in FIG. 4. The attaching and lifting mechanism 22 is manually lifted to a vertical position with the assistance of the torsion springs 72, and the base support arms 52 are positioned to rest against the outer surface of the pedestal 56. The ratchet buckle tie-downs 58 are wrapped around the pedestal 56 and tightened in place. The pole attaching arms 78 are adjusted in length to correspond to the dimensions of the pedestal 56 and tilted horizontally by rotating the lifting actuator 68' by hand or with an electric drill. The pole 74 is then manually placed on the attaching arms 78 and buckled in place. The pole tilting mechanism 24 is then rotated to the vertical position, which places the pole directly above the studs in the pedestal. The lifting actuator 68 of the attaching and lifting mechanism 22 is then rotated, thereby lowering the pole 74 over the pedestal and permitting the required electrical connection to be made. The pole 74 is then completely lowered to finish attachment of the studs into the pole base plate.

Figure 12:
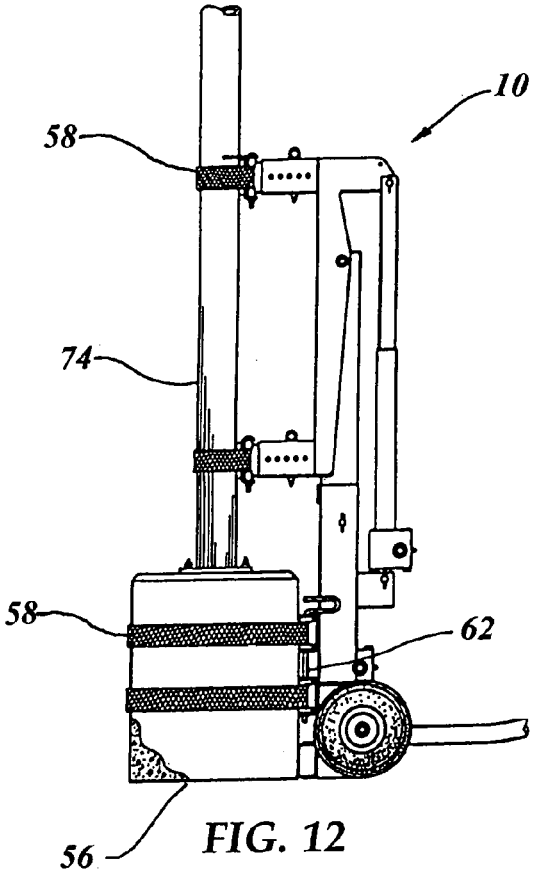
FIG. 12 is a left side view of the invention attached to a concrete pedestal and a pole ready for removal.
Figure 13:
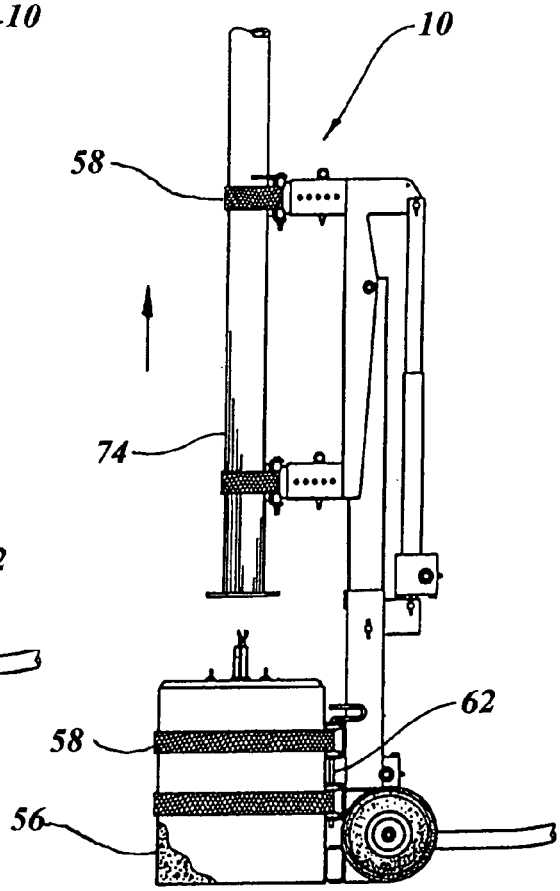
FIG. 13 is a left side view of the invention attached to a concrete pedestal and a pole, with the pole lifted up away from the pedestal during the removal procedure.

During removal of a pole 74 for repair or replacement of lights on the pole the opposite procedure is followed. FIG. 12 illustrates the connection to the pedestal 56 and pole 74, with FIG. 13 showing the pole being removed by lifting in an upward direction. FIG. 14 shows the pole 74 being rotated for access.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A light pole erector and remover for a pedestal mounted light pole comprising:

a) a transportation dolly having a frame with fixed wheels on a first end, and steerable wheels attached to a tongue on a second end, b) a pedestal attaching and lifting mechanism that is hingably connected to said dolly, the pedestal attaching and lifting mechanism having a plurality of base support arms configured to embrace a concrete pedestal, with each arm having a ratchet buckle tie-down for encircling the pedestal, thus removably securing the mechanism to the pedestal, and c) a pole tilting mechanism that is pivotally affixed to said pedestal attaching and lifting mechanism, with said pole tilting mechanism having a plurality of ratchet buckle tie-downs encircling a pole, securing the pole to the tilting mechanism such that the pole may be manually positioned in a horizontal manner on the tilting mechanism, tied down and rotated to a vertical position over the concrete pedestal and then lowered for attachment to the pedestal, also permitting the pole to be removed for repair or replacement in a reverse order.

2. The light pole erector and remover as recited in claim 1 wherein said transportation dolly frame further comprises a tubular metallic construction, with said tongue defined as a pivoting tee handle, thereby permitting the dolly to be manually steered when pulled or pushed in a forward or aft direction.

3. The light pole erector and remover as recited in claim 2 wherein said transportation dolly frame tongue tee handle further comprises means for locking the handle in an upright position for storage.

4. The light pole erector and remover as recited in claim 1 wherein said transportation dolly frame further comprises a pair of fifth wheel pindle, steerable wheels located on said second end, and an axle mounted fixed wheels located on said first end.

5. The light pole erector and remover as recited in claim 1 wherein said transportation dolly frame wheels further comprising wheel rims with pneumatic tires.

6. The light pole erector and remover as recited in claim 1 wherein said attaching and lifting mechanism further comprises a pair of opposed, upright channel guides, a sliding glide rail assembly that is disposed within the channel guides, a screw type lifting actuator that is located within the sliding glide rail assembly, a bottom positioner that is connected to a front surface of said channel guides, and a bumper that is attached to each base support arm.

7. The light pole erector and remover as recited in claim 1 wherein said attaching and lifting mechanism base support arms each having bores therethrough, with a plurality of removable ratchet attaching pins disposed through said bores for attaching the attaching and lifting mechanism to a concrete pedestal.

8. The light pole erector and remover as recited in claim 1 further comprising at least one counterbalance torsion spring that is positioned between the attaching and lifting mechanism and the transportation dolly for ease of manual lifting.

9. The light pole erector and remover as recited in claim 1 wherein said pole tilting mechanism further comprises:

a) a channel shaped pivotal member having a pair of adjustable pole attaching arms that are each attached on opposed ends onto a web portion of the channel shaped member, said arms receiving the ratchet buckle tie-downs, and b) a screw type lifting actuator attached to one end of the pivotal member for rotating the member from a horizontal to a vertical position.

10. The light pole erector and remover as recited in claim 9 wherein said channel shaped pivotal member is formed from a flat sheet of material.

11. The light pole erector and remover as recited in claim 9 further comprising a plurality of removable, ratchet attaching bolts through said adjustable pole attaching arms.

12. The light pole erector and remover as recited in claim 1 wherein said pole tilting mechanism pivots from 0 to essentially 120 degrees relative to the transportation dolly and is configured to be manually liftable by one person.

13. The light pole erector and remover as recited in claim 1 sized to fit a concrete pedestal that protrudes above the ground at a height from 18 inches to 36 inches (45.7 to 91 centimeters).

14. The light pole erector and remover as recited in claim 1 wherein said pedestal attaching and lifting ratchet buckle tie-downs are rated to at least 2,500 pounds (1135 kg) and have 2 inch (5.1 cm) wide straps.

15. The light pole erector and remover as recited in claim 1 wherein said pole tilting mechanism tie-downs are rated to at least 2,500 pounds (1135 kg) and have 2 inch (5.1 cm) wide straps.

16. The light pole erector and remover as recited in claim 1 wherein said pole tilting mechanism tie-downs accommodate square, polygonal, round and irregular shaped poles.

17. The light pole erector and remover as recited in claim 1 wherein said attaching and lifting mechanism is pivotally attached to the transporting dolly with a hinge pin having retaining rings on each end.

* * * * *